US008236163B2

(12) United States Patent
Garimella et al.

(10) Patent No.: US 8,236,163 B2
(45) Date of Patent: Aug. 7, 2012

(54) ANODE MEDIA FOR USE IN ELECTROPLATING PROCESSES, AND METHODS OF CLEANING THEREOF

(75) Inventors: Balaji Rao Garimella, Singapore (SN); Supramaniam Suppiah, Singapore (SN); Davan Gassappan, Malaysia (MY)

(73) Assignee: United Technologies Corporation, Hartford, CT (US)

( * ) Notice: Subject to any disclaimer, the term of this patent is extended or adjusted under 35 U.S.C. 154(b) by 298 days.

(21) Appl. No.: 12/562,756

(22) Filed: Sep. 18, 2009

(65) Prior Publication Data

US 2011/0068010 A1 Mar. 24, 2011

(51) Int. Cl.
*C25F 3/16* (2006.01)

(52) U.S. Cl. ..... 205/705; 205/687; 205/709; 205/766; 205/771; 205/280

(58) Field of Classification Search ..... 205/687, 205/705, 709, 766, 771; 204/280
See application file for complete search history.

(56) References Cited

U.S. PATENT DOCUMENTS

| | | | | |
|---|---|---|---|---|
| 3,155,536 | A | 11/1964 | Freeman, Jr. et al. | |
| 4,227,703 | A | 10/1980 | Stalker et al. | |
| 4,802,828 | A | 2/1989 | Rutz et al. | |
| 4,977,036 | A | 12/1990 | Baldi | |
| 5,074,970 | A | 12/1991 | Routsis et al. | |
| 5,536,022 | A | 7/1996 | Sileo et al. | |
| 5,603,603 | A | 2/1997 | Benoit et al. | |
| 5,935,407 | A | 8/1999 | Nenov et al. | |
| 6,306,277 | B1 | 10/2001 | Strangman et al. | |
| 6,434,876 | B1 | 8/2002 | Wheat et al. | |
| 6,463,992 | B1 | 10/2002 | Dowhan et al. | |
| 6,537,021 | B2 | 3/2003 | Howard et al. | |
| 6,887,036 | B2 | 5/2005 | Ohara et al. | |
| 6,896,485 | B2 | 5/2005 | Ohara et al. | |
| 2,278,821 | A1 | 10/2007 | O'Reilly et al. | |
| 2003/0226766 | A1 * | 12/2003 | Orlebeke | 205/688 |
| 2004/0255783 | A1 | 12/2004 | Graham et al. | |
| 2006/0124454 | A1 * | 6/2006 | Wurm et al. | 204/286.1 |
| 2006/0216936 | A1 * | 9/2006 | Akatsuka | 438/691 |
| 2007/0084131 | A1 * | 4/2007 | Palmgren | 51/293 |
| 2008/0014348 | A1 | 1/2008 | Gupta et al. | |

FOREIGN PATENT DOCUMENTS

WO WO2004112937 A1 12/2004

OTHER PUBLICATIONS

"Electroplating—Wikipedia, the free encyclopedia", from http://en.wikipedia.org/wiki/Electroplating, (visited Dec. 18, 2009) (5 pages).

* cited by examiner

*Primary Examiner* — Bruce Bell
(74) *Attorney, Agent, or Firm* — Kinney & Lange, P.A.

(57) ABSTRACT

A method for cleaning anode media, the method comprising removing the anode media from an electroplating system, and removing scale coatings from substrates of the anode media by vibrational polishing the anode media with abrasive particles.

16 Claims, 2 Drawing Sheets

ANODE MEDIA FOR USE IN ELECTROPLATING PROCESSES, AND METHODS OF CLEANING THEREOF

BACKGROUND

The present invention relates to electroplating processes for forming protective coatings on metal components, such as gas turbine engine components. In particular, the present invention relates to anode media used in electroplating processes, and methods for cleaning the anode media.

Components of a gas turbine engine are typically subjected to extreme temperatures and pressures during the course of operation, particularly in the high-pressure turbine stages of the turbine engine. To protect the turbine engine components from the extreme conditions, the components typically include metallic coatings that provide oxidation and/or corrosion resistance. The metallic coatings may also function as bond coats to adhere thermal barrier coatings to the substrates of the turbine engine components, and as particle matrices for retaining abrasive particles (e.g., cubic boron nitride (CBN) particles).

Electroplating processes are used to apply a variety of metallic coatings on turbine engine components, such as platinum and CBN-nickel coatings. A coating is typically formed by immersing a turbine engine component in a plating solution that contains metal salts of the intended coating. The anode of the electroplating system is also typically provided as anode media (e.g., pellets and shots) derived of the intended coating metal. An electrical current is then induced through the plating solution, which disassociates the metal salts to form charged metallic ions. The charged metallic ions then bond to the surfaces of the turbine engine component to form the desired coating.

As the charged metallic ions are consumed from the plating solution, the anode media are slowly dissolved to replenish the charged metallic ions in the plating solution. Thus, the continued effectiveness of an electroplating process is dependent on the emission of charged metallic ions from the anode media. However, a common issue with electroplating processes involves the formation of oxide and/or residue scale coatings on the surfaces of the anode media. These scale coatings block the emission of the charged metallic ions from the anode media, thereby reducing the rate at which the plating solution is replenished. Over multiple electroplating processes, the anode media becomes no longer effective at emitting charged metallic ions. At this point, the used anode media is typically discarded and replaced with fresh anode media, thereby increasing material costs for performing the electroplating processes. As such, there is an ongoing need to techniques for increasing the product lives of used anode media in electroplating systems.

SUMMARY

The present invention relates to anode media used in electroplating processes, and a method for cleaning the anode media. The method includes removing the anode media from an electroplating system, where the removed anode media include substrates and scale coatings formed on the substrates over multiple electroplating processes. The method further includes removing the scale coatings from the substrates by vibrational polishing the anode media with abrasive particles.

DETAILED DESCRIPTION

Figure 1:
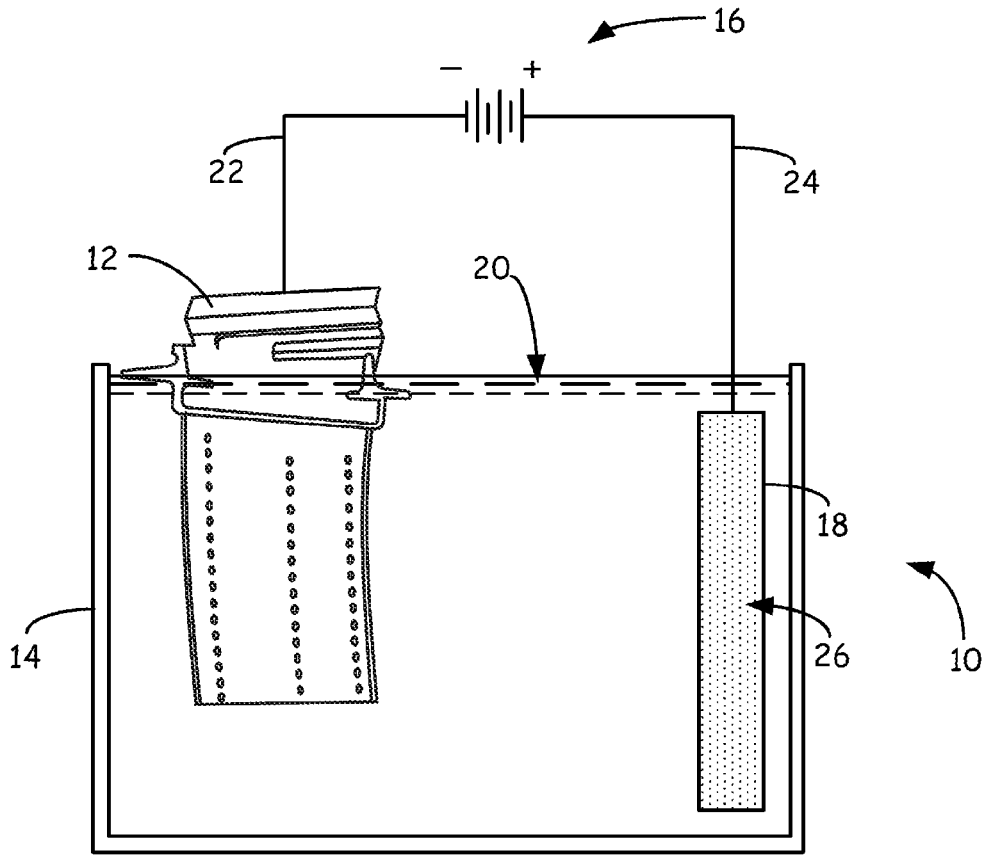
FIG. 1 is a schematic illustration of an electroplating system, which illustrates the use of anode media in an electroplating process.

FIG. 1 is a schematic illustration of electroplating system 10 in use with turbine blade 12, which illustrates the use of anode media in an electroplating process. As discussed below, the method of the present invention is suitable for cleaning used anode media, which increases the product lives of the anode media for use in electroplating systems, such as system 10. As further discussed below, the method of the present invention incorporates a vibrational polishing treatment for cleaning the used anode media. This is beneficial over a chemical-based treatment, which may impose a risk of introducing cleaning chemicals into subsequent electroplating processes.

As shown in FIG. 1, system 10 includes tank 14, power supply 16, and anode container 18. Tank 14 is a reservoir that contains plating solution 20, where plating solution 20 includes a metal salt dispersed or dissolved in a carrier fluid. Plating solution 20 may also include one or more types of particles (e.g., CBN abrasive particles) dispersed in the carrier fluid. Power supply 16 provides electrical power for the electroplating process, and includes negative terminal 22 in contact with turbine blade 12 and positive terminal 24 in contact with anode container 18.

Anode container 18 is the anode portion of system 10, and includes a plurality of anode media 26. As used herein, the term "anode media" refers to media (e.g., pellets, shots, nuggets, bars, rods, and the like) that collectively function as at least a portion an electroplating anode, and as sources of charged metallic ions for replenishing plating solutions during electroplating processes. Thus, anode media 26 are desirably derived of the same metal as the metal salt of plating solution 20. Examples of suitable materials for anode media 26 include one or more plating materials, such as nickel, chromium, cobalt, platinum, and combinations thereof. For example, anode media 26 may be derived from nickel for use in a CBN electroplating process to form an abrasive nickel coating on turbine blade 12 (e.g., on the tip of turbine blade 12).

During an electroplating process, anode media 26 are placed in anode container 18 to function as an anode portion of system 10. Turbine blade 12 is immersed in plating solution 20 and is connected to negative terminal 22 of power supply 16. A positive charge is then placed on anode container 18 and anode media 26 via positive terminal 24. A negative charge is also placed on turbine blade 12 via negative terminal 22. This induces an electrical current through plating solution 20, which causes the metal salts of plating solution 20 to disassociate to form charged metallic ions. The negative charge placed on turbine blade 12 attracts the charged metallic ions toward the exposed surfaces of turbine blade 12. Upon contact with turbine blade 12, the charges on the metallic ions are reduced to form a metal coating bonded to the surfaces of turbine blade 12.

Over successive electroplating processes in system 10, anode media 26 are slowly dissolved to replenish the metallic ions in plating solution 20. This correspondingly reduces the dimensions of anode media 26. As such, anode media 26 are consumable materials that are desirably used up before being replaced to maximize the product lives of the materials. However, before anode media 26 are fully consumed, scale coatings form over the exterior surfaces of anode media 26. The scale coatings inhibit the emission of charged metallic ions from anode media 26, which, in conventional electroplating operations, require anode media 26 to be discarded and replaced with fresh anode media. However, as discussed below, the method of the present invention removes the scale coatings from anode media 26, thereby allowing anode media 26 to be substantially (or fully) consumed before being replaced with fresh anode media.

Figure 2:
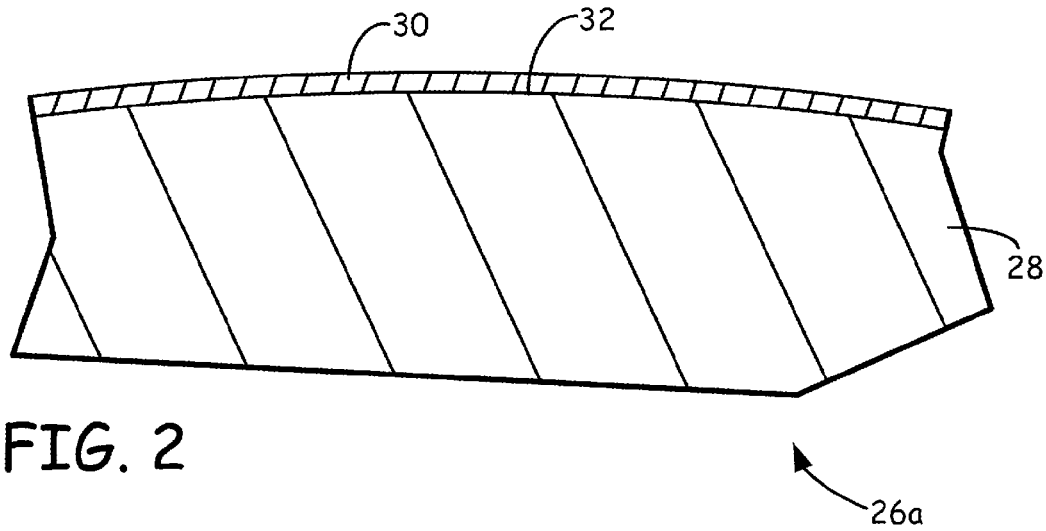
FIG. 2 is a sectional view of a portion of an anode medium used in an electroplating system, where the anode medium contains a scale coating.

FIG. 2 is a sectional view of a portion of anode medium 26*a*, which is a single anode medium of anode media 26 (shown in FIG. 1) after being used in multiple electroplating processes with system 10 (shown in FIG. 1). As shown in FIG. 2, anode medium 26*a* includes substrate 28 and scale coating 30, where substrate 28 includes surface 32. Substrate 28 is the bulk portion of anode media 26*a*, and has a composition derived from the desired plating materials, as discussed above. Surface 32 is an exterior surface of substrate 28 and is the surface from which the charged metallic ions are emitted during an electroplating process.

Scale coating 30 is a coating of oxidized materials and/or dried plating solutions formed on surface 32. Over the course of multiple electroplating processes, the exterior surfaces of anode media 26 (including surface 32 of anode medium 26*a*) are subjected to oxidizing conditions, which forms oxide scales on the exterior surfaces. Furthermore, in-between electroplating processes, anode media 26 are removed from anode container 18, and are air dried for temporary storage. As a result, over repeated electroplating and drying operations, the exterior surfaces of anode media 26 build up residual dried layers of plating solution 20, which may also oxidize. Eventually, the build up of the scale coatings (e.g., scale coating 30) restrict the emission of the charged metallic ions from the exterior surfaces of anode media 26. This prevents anode media 26 from effectively replenishing plating solution 20 during the electroplating processes. Thus, in a conventional electroplating operation, when the scale coatings are formed, anode media 26 are discarded and replaced with fresh anode media for use in subsequent electroplating processes. This unfortunately wastes the materials of anode media 26, which are not fully consumed before being discarded, and increases material costs for performing electroplating processes. However, as discussed below, the method of the present invention provides a means for removing the scale coatings from anode media 26 without the use of chemical-based treatments. This allows anode media 26 to be reused in electroplating processes, and to be fully consumed before being replaced with fresh anode media.

Figure 3:
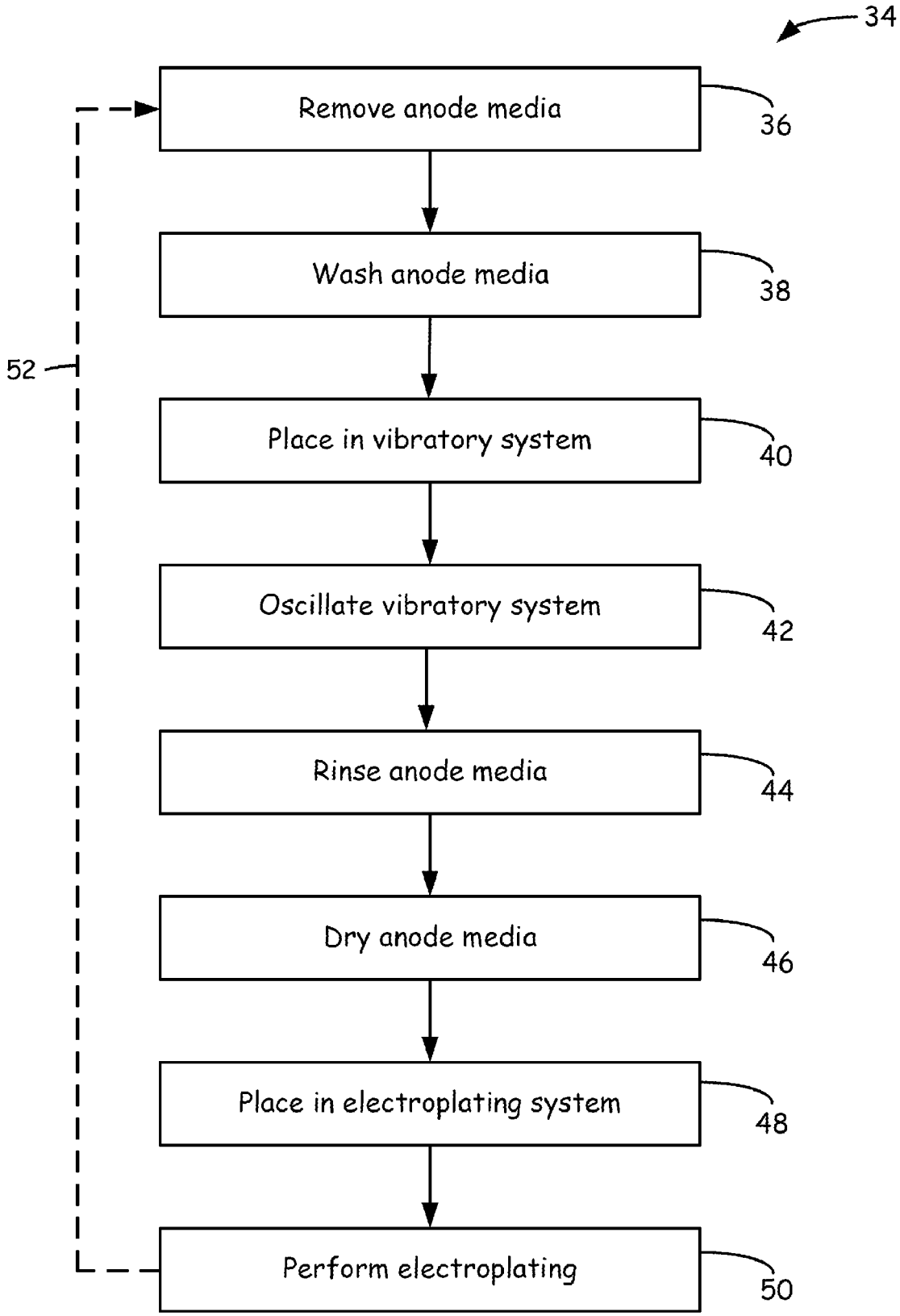
FIG. 3 is a flow diagram of a method for cleaning anode media used in an electroplating system.

FIG. 3 is a flow diagram of method 34 for cleaning anode media 26 (shown in FIG. 1), which allows anode media 26 to be reused in subsequent electroplating processes. The following discussion of method 34 is made with reference to system 10 (shown in FIG. 1), anode media 26 (shown in FIG. 1), and anode medium 26*a* (shown in FIG. 2) with the understanding that method 34 is suitable for cleaning anode media that are used to electroplate a variety of different metal components. As shown in FIG. 3, method 34 includes steps 36-50, and initially involves removing anode media 26 from anode container 18 (step 36). This is desirably performed at, or before, a point at which the scale coatings (e.g., scale coating 30) formed on anode media 26 attain thicknesses that cause unacceptable levels of inhibition for the emission of the charged metallic ions.

Anode media 26 is then washed with a fluid (e.g., water) to remove any residual plating solution remaining on anode media 26, and to further remove any extraneous materials on anode media 26 (step 38). The cleaning process of method 34 desirably minimizes the amount of chemical-based treatments performed on anode media 26. As used herein, the term "chemical-based treatment" refers to treatments that incorporate chemicals to remove (e.g., dissolve) the scale coatings form anode media 26. Such chemicals, if not properly removed themselves, can pose a risk of contaminating plating solution 20 during the subsequent electroplating processes in system 10. Additionally, aggressive chemicals may adversely react with the substrates of anode media 26 (e.g., substrate 28 of anode medium 26*a*), thereby degrading the substrates of anode media 26.

After rinsing, anode media 26 is then placed in a container of a vibratory system (step 40), and the container is oscillated to abrasively remove the scale coatings from anode media 26 (step 42). Thus, the scale coatings are removed from the substrates of anode media 26 with a vibrational polishing process. In one embodiment, the vibratory system is a vibratory polishing system configured to oscillate at a high frequency, thereby abrasively removing the scale coatings (e.g., scale coating 30) from anode media 26 without substantially damaging the substrates of anode media 26. Examples of suitable vibratory systems for use with method 34 include finishing mills commercially available from Sweco (a business unit of M-I, LLC), Florence, Ky.

The container of the vibratory system desirably includes one or more types of abrasive particles to assist in removing the scale coatings from anode media 26 during the vibrational polishing process. The abrasive particles are desirably selected to substantially remove the scale coatings, while also substantially preserving the integrity of the substrates of anode media 26. Examples of suitable abrasive particles for use in the vibratory system include alumina particles, such as polycrystalline alpha alumina, calcinated alpha alumina, calcinated gamma alumina, and combinations thereof. Examples of suitable average particle sizes for the abrasive particles range from about 1 millimeter to about 10 millimeters, with particularly suitable average particles sizes ranging from about 3 millimeters to about 6 millimeters The container of the vibratory system may also include one or more fluids (e.g., water) to assist in the mixing of anode media 26 and the abrasive particles during the vibrational polishing process.

The vibrational polishing process of step 42 is desirably performed at a suitable oscillation frequency and duration to substantially remove the scale coatings from anode media 26. Examples of suitable oscillation frequencies for the vibrational polishing process range from about 500 oscillations/minute to about 2,000 oscillations/minute, with particularly suitable oscillation frequencies ranging from about 1,000 oscillations/minute to about 1,500 oscillations/minute. Examples of suitable durations for the vibrational polishing process range from about 30 minutes to about 5 hours, with particularly suitable durations ranging from about 1 hour to about 3 hours.

After the vibrational polishing process is complete, anode media 26 are removed from the container of the vibratory system, and are rinsed with a fluid (e.g., water) to remove the residual scale coatings and abrasive particles from the surfaces of anode media 26 (step 44). Anode media 26 are then oven dried to remove the remaining moisture (step 46). Examples of suitable drying temperatures range from about 75° C. to about 150° C., with particularly suitable drying temperatures ranging from about 90° C. to about 120° C. Examples of suitable durations for drying anode media 26 range from about 1 hour to about 5 hours, with particularly suitable drying durations ranging from about 2 hours to about 3 hours.

After drying, anode media 26 may be placed back into anode container 18 of system 10 (step 48) for use in subsequent electroplating processes (step 50). As discussed above, method 34 substantially removes the scale coatings from anode media 26 (i.e., surface 32 is substantially free of scale coating 30), thereby providing clean, exposed surfaces of the substrates of anode media 26. This allows anode media 26 to continue to emit charged metallic ions during subsequent electroplating processes to replenish plating solution 20. Over the subsequent electroplating processes, additional scale coatings may form on anode media 26 prior to anode media 26 being substantially or fully consumed. If so, method 34 may be repeated (as represented by arrow 52 in FIG. 3) to remove the additional scale coatings from anode media 26. Accordingly, during the product lives of anode media 26, method 34 may be performed multiple times on anode media 26. This extends the product lives of anode media 26, thereby allowing anode media 26 to be substantially (or fully) consumed prior to being replaced with fresh anode media. This accordingly reduces material costs for performing electroplating processes with system 10.

EXAMPLE

The present invention is more particularly described in the following example that is intended as an illustration only, since numerous modifications and variations within the scope of the present invention will be apparent to those skilled in the art. Multiple electroplating processes and a cleaning process (pursuant to method 34, shown in FIG. 3) were performed on nickel shots (i.e., anode media) to analyze the effectiveness of the cleaning process. Prior to performing the cleaning process, the nickel shots were used in multiple electroplating processes (in the same electroplating system) to form abrasive coatings on turbine blade tips, where the abrasive coatings included CBN particles entrained in nickel matrices. The nickel shots had diameters ranging from about 4 millimeters to about 10 millimeters, and were retained in a anode bag that was in contact with a positive terminal of a system power supply. The turbine blade tips were then immersed in a plating solution and connected to a negative terminal of the system power supply. The plating solution contained a nickel salt and CBN particles dispersed and/or dissolved in water.

During each of the multiple electroplating processes, a positive charge was placed on the nickel shots via the positive terminal, and negative charges were placed on the turbine blades via the negative terminal. This induced an electrical current through the plating solution, which caused the nickel salts to disassociate to form charged nickel ions. The negative charges placed on the turbine blades caused the charged nickel ions to attract to the blade tips with the CBN particles. Upon contact with the blade tips, the charges on the nickel ions were reduced, thereby forming nickel coatings on the blade tips with CBN particles entrained in the nickel.

During the electroplating processes, charged nickel ions were also emitted from the nickel shots to replenish the nickel ions in the plating solution. This slowly dissolved the nickel shots, thereby reducing the dimensions of the nickel shots. In-between the electroplating processes, the nickel shots were removed from the electroplating system and air dried for temporary storage. Additionally, the nickel shots and the coated turbine blades were visually and metallographically analyzed to identify the formation of scale coatings on the nickel shots, and to identify reductions in electroplating efficiencies due to the formation of the scale coatings. After performing the electroplating processes for several days, the electroplating efficiencies eventually reached a level that was no longer acceptable for coating the turbine blade tips. At this point, the nickel shots were removed from the anode bags and were washed with water to remove residual plating solution.

After washing, the nickel shots were placed in a cast polyurethane elastomer container of a vibratory system commercially available under the trade designation "FM-10C" Batch Mill from Sweco (a business unit of M-I, LLC), Florence, Ky. The container of the vibratory system included one liter of water and alumina cone particles having diameters ranging from about 3 millimeters to about 6 millimeters. The vibratory system was then operated at an oscillation frequency of 1,200 oscillations/minute for a duration of 2 hours. After the vibratory process was completed, the nickel shots were removed from the container and rinsed to remove the residual scale coatings and alumina cone particles. The nickel shots were then oven dried at 107° C. (225° F.) for 2 hours.

At this point, no remaining scale coatings were visually observable on the nickel shots, and the exterior surfaces of the nickel shots visually appeared to be clean. The nickel shots were then placed back into the anode bag of the electroplating system, and an additional electroplating process was performed using the cleaned nickel shots. After the electroplating process, a subsequent visual and metallographical analysis identified that the nickel shots cleaned pursuant to method 38 exhibited a high emission rate of charged nickel ions, which was similar to the emission rate observed with fresh, new nickel shots. Thus, the cleaning process performed pursuant to method 38 provided a suitable means to clean anode media for use in additional electroplating processes.

Although the present invention has been described with reference to preferred embodiments, workers skilled in the art will recognize that changes may be made in form and detail without departing from the spirit and scope of the invention.

The invention claimed is:

1. A method for cleaning anode media used in an electroplating system, the method comprising:

removing the anode media from the electroplating system, wherein the removed anode media comprise substrates and scale coatings formed on the substrates over multiple electroplating processes; and removing the scale coatings from the substrates by vibrational polishing the anode media with abrasive particles.

2. The method of claim 1, wherein removing the scale coatings from the substrates by vibrational polishing comprises:

placing the anode media in a container that comprises the abrasive particles; and oscillating the container to substantially remove the scale coatings from the substrates of the anode media with the use of the abrasive particles.

3. The method of claim 1, further comprising:

washing the anode media after the scale coatings are removed; and drying the washed anode media at a temperature ranging from about 75° C. to about 150° C.

4. The method of claim 1, wherein the vibrational polishing is performed at an oscillation frequency ranging from about 500 oscillations/minute to about 2,000 oscillations/minute.

5. The method of claim 4, wherein the oscillation frequency ranges from about 1,000 oscillations/minute to about 1,500 oscillations/minute.

6. The method of claim 1, wherein the vibrational polishing is performed for a duration ranging from about 30 minutes to about 5 hours.

7. The method of claim 1, wherein the abrasive particles are selected from the group consisting of polycrystalline alpha alumina, calcinated alpha alumina, calcinated gamma alumina, and combinations thereof.

8. The method of claim 1, wherein the substrates of the anode media comprise a material selected from the group consisting of nickel, chromium, cobalt, platinum, and combinations thereof.

9. A method for using anode media with an electroplating system, the method comprising:

providing used anode media comprising substrates and scale coatings disposed on the substrates, wherein the scale coatings comprise at least one oxidized material;

placing the used anode media in a container that comprises abrasive particles;

oscillating the container to cause the abrasive particles to abrasively contact the used anode media, thereby substantially removing the scale coatings from the substrates of the used anode media to provide clean anode media;

placing the clean anode media in the electroplating system; and performing at least one electroplating process with the electroplating system using the clean anode media.

10. The method of claim 9, wherein the oscillation of the container is performed at an oscillation frequency ranging from about 500 oscillations/minute to about 2,000 oscillations/minute.

11. The method of claim 9, wherein the oscillation of the container is performed for a duration ranging from about 30 minutes to about 5 hours.

12. The method of claim 9, further comprising:

placing fresh anode media in the electroplating system; and performing a plurality of electroplating processes with the electroplating system using the fresh anode media, thereby forming the used anode media.

13. The method of claim 9, wherein the abrasive particles are selected from the group consisting of polycrystalline alpha alumina, calcinated alpha alumina, calcinated gamma alumina, and combinations thereof.

14. The method of claim 9, wherein the substrates of the used anode media comprise a material selected from the group consisting of nickel, chromium, cobalt, platinum, and combinations thereof.

15. A used anode medium comprising:

a substrate derived from a substrate material; and an abrasively-cleaned surface of the substrate that previously emitted a plurality of metallic ions of the substrate material during at least one electroplating process prior to being abrasively cleaned, and that previously formed a scale coating prior to being abrasively cleaned, wherein the used anode now contains an abrasively-cleaned exterior surface that is substantially free of the scale coating after being abrasively cleaned.

16. The used anode medium of claim 15, wherein the substrate material is selected from the group consisting of nickel, chromium, cobalt, platinum, and combinations thereof.

* * * * *